US009514873B2

(12) United States Patent
Yu et al.

(10) Patent No.: US 9,514,873 B2
(45) Date of Patent: Dec. 6, 2016

(54) CHOKE COIL

(71) Applicant: SAMSUNG ELECTRO-MECHANICS CO., LTD., Suwon-Si, Gyeonggi-Do (KR)

(72) Inventors: Seung Wan Yu, Suwon-Si (KR); Hee Seung Kim, Suwon-Si (KR); Jae Sun Won, Suwon-Si (KR); Young Min Lee, Suwon-Si (KR); Seung Ho Han, Suwon-Si (KR); Hwa Hun Chin, Suwon-Si (KR)

(73) Assignee: SOLUM CO., LTD, Suwon-Si (KR)

( * ) Notice: Subject to any disclaimer, the term of this patent is extended or adjusted under 35 U.S.C. 154(b) by 0 days.

(21) Appl. No.: 14/594,055

(22) Filed: Jan. 9, 2015

(65) Prior Publication Data

US 2015/0255204 A1 Sep. 10, 2015

(30) Foreign Application Priority Data

Feb. 14, 2014 (KR) ..... 10-2014-0017164

(51) Int. Cl.

| | |
|---|---|
| ***H01F 27/24*** | (2006.01) |
| ***H01F 27/28*** | (2006.01) |
| ***H01F 17/04*** | (2006.01) |
| ***H01F 17/06*** | (2006.01) |
| ***H01F 3/10*** | (2006.01) |
| *H01F 27/32* | (2006.01) |

(52) U.S. Cl.
CPC ..... *H01F 17/06* (2013.01); *H01F 3/10* (2013.01); *H01F 27/324* (2013.01)

(58) Field of Classification Search
CPC ..... H01F 27/24
USPC ..... 336/212
See application file for complete search history.

(56) References Cited

U.S. PATENT DOCUMENTS

| | | | | |
|---|---|---|---|---|
| 3,195,083 | A * | 7/1965 | Wetherill | H01F 37/005 336/12 |
| 4,471,271 | A * | 9/1984 | Wendt | 315/411 |
| 2011/0025445 | A1* | 2/2011 | Lai et al. | 336/220 |
| 2013/0113587 | A1* | 5/2013 | Inoue et al. | 336/5 |

FOREIGN PATENT DOCUMENTS

| | | | |
|---|---|---|---|
| JP | 2004311473 | A | 11/2004 |
| JP | 2006173201 | A | 6/2006 |
| JP | 2007-088405 | A | 4/2007 |
| JP | 2013-168476 | A | 8/2013 |
| KR | 10-2012-0070228 | A | 6/2012 |

OTHER PUBLICATIONS

Korean Office Action, issued in corresponding Korean Patent Application, mailed on Apr. 3, 2015; 4 pages in Korean language.

* cited by examiner

*Primary Examiner* — Mangtin Lian
*Assistant Examiner* — Ronald Hinson
(74) *Attorney, Agent, or Firm* — McDermott Will & Emery LLP

(57) ABSTRACT

Disclosed herein is a choke coil including: a core composed of first and second legs, a first flat plate connecting an upper end portion of the first leg and that of the second leg, and a second flat plate connecting a lower end portion of the first leg and that of the second leg; a primary coil wound around the first leg; and a secondary coil wound around the second leg, wherein a width of at least any one of the first flat plate and the second flat plate is greater than widths of the first leg and the second leg.

6 Claims, 6 Drawing Sheets

CHOKE COIL

CROSS REFERENCE(S) TO RELATED APPLICATIONS

This application claims the benefit under 35 U.S.C. Section 119 of Korean Patent Application Serial No. 10-2014-0017164, entitled "Choke Coil" filed on Feb. 14, 2014, which is hereby incorporated by reference in its entirety into this application.

BACKGROUND

1. Technical Field

The present invention relates to a choke coil, and more particularly, to a choke coil that may be used as a common mode filter, or the like, of an electromagnetic interference (EMI) filter.

2. Description of the Related Art

Recently, efforts to increase a processing speed of products, while reducing an overall size and thickness of the exterior thereof, have continued in the market in flat panel displays (FPDs) such as liquid crystal displays (LCDs), plasma display panels (PDPs), and light emitting diodes (LEDs), or the like, which, however, accompanies various problems arising due to electromagnetic interference (EMI).

Meanwhile, a power supply device is essential for display devices or any other electric/electronic devices to supply power, and among power supply devices, a switching mode power supply (SMPS) using a switching function of a semiconductor device and a power conversion function of a transformer converts commercial power into highly efficient and high quality power required for various electronic products and supplies the same.

However, the SMPS causes a large amount of noise due to electromagnetic interference (EMI) when a switching operation is performed.

EMI may be divided into conducted emission EMI and radiated emission EMI, and the conducted emission EMI and the radiated emission EMI may also be classified into a differential mode noise and a common mode node, respectively.

In order to cancel such EMI as mentioned above, an EMI filter may be employed in a power source input terminal to which commercial alternating current (AC) power is input, as disclosed in Prior Art Document.

In detail, in order to reduce differential mode noise, the EMI filter mainly uses a normal mode choke coil and an X capacitor, and in order to reduce common mode noise, the EMI filter uses a common mode choke coil and a Y capacitor.

The EMI filter employs a choke coil having a low frequency band and a choke coil having a high frequency band to secure a large frequency band to cancel electromagnetic interference, which, however, results in an increase in an overall size of the exterior of a product, failing to meet the consumer demand for lighter, thinner, shorter, and smaller products.

Meanwhile, in an EMI filter, magnetizing inductance Lm characteristics of a choke coil may reduce common mode noise and leakage inductance Lk characteristics thereof may reduce differential mode noise, but in a situation in which products are increasingly reduced in size and thickness, there is a limitation in increasing both magnetizing inductance Lm and leakage inductance Lk.

SUMMARY

An object of the present invention is to provide a choke coil having improved magnetizing inductance Lm and leakage inductance Lk, while reducing a size and a thickness of a product.

Another object of the present invention is to provide a choke coil capable of promoting ease in processing by stably supporting a primary coil and a secondary coil wound around a core and capable of security competitiveness by reducing manufacturing costs.

According to an exemplary embodiment of the present invention, there is provided a choke coil including: a core composed of first and second legs, a first flat plate connecting an upper end portion of the first leg and that of the second leg, and a second flat plate connecting a lower end portion of the first leg and that of the second leg; a primary coil wound around the first leg; and a secondary coil wound around the second leg, wherein a width of at least any one of the first flat plate and the second flat plate is greater than widths of the first leg and the second leg.

A width of at least any one of the first flat plate and the second flat plate may be equal to widths of the primary coil and the secondary coil.

A length of at least any one of the first flat plate and the second flat plate may be greater than a distance between an outer side wall of the first leg and an outer side wall of the second leg.

At least any one of the first flat plate and the second flat plate may include two linear lines disposed to be parallel in a longer axis direction and two curved lines connecting both ends of the two linear lines.

A width of the first flat plate or the second flat plate may be equal to widths of the primary coil and the secondary coil, and a curved line region of the first flat plate or the second flat plate may be identical to outer circumferential surfaces of the primary coil and the secondary coil in a vertical line.

The primary coil and the secondary coil may have a flat type copper wire.

Surfaces of the primary coil and the secondary coil may be coated with an insulator.

The first leg and the second leg may have a cylindrical shape or a square pillar shape.

The first leg, the second leg, the first flat plate, and the second flat plate constituting the core may be integrally formed.

DESCRIPTION OF THE PREFERRED EMBODIMENTS

Figure 1:
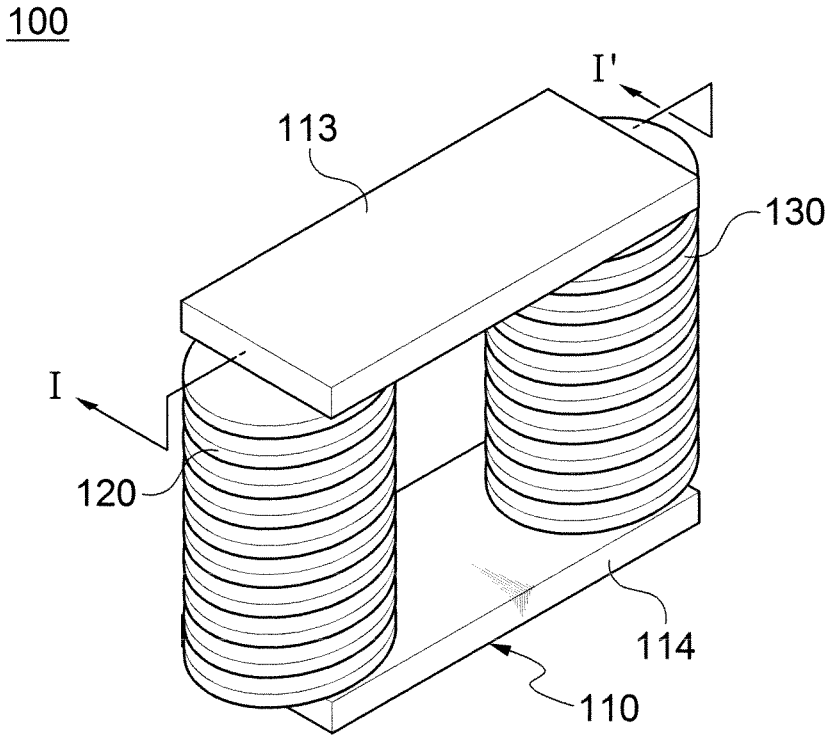
FIG. 1 is a perspective view illustrating a choke coil according to an exemplary embodiment of the present invention.

Various advantages and features of the present invention and technologies accomplishing thereof will become apparent from the following description of exemplary embodiments with reference to the accompanying drawings. However, the present invention may be modified in many different forms and it should not be limited to exemplary embodiments set forth herein. These exemplary embodiments may be provided so that this disclosure will be thorough and complete, and will fully convey the scope of the invention to those skilled in the art.

Terms used in the present specification are for explaining exemplary embodiments rather than limiting the present invention. Unless specifically mentioned otherwise, a singular form includes a plural form in the present specification. The word "comprise" and variations such as "comprises" or "comprising," will be understood to imply the inclusion of stated constituents, steps, operations and/or elements but not the exclusion of any other constituents, steps, operations and/or elements.

For simplification and clearness of illustration, a general configuration scheme will be shown in the accompanying drawings, and a detailed description of the feature and the technology well known in the art will be omitted in order to prevent a discussion of exemplary embodiments of the present invention from being unnecessarily obscure. Additionally, components shown in the accompanying drawings are not necessarily shown to scale. For example, sizes of some components shown in the accompanying drawings may be exaggerated as compared with other components in order to assist in understanding of exemplary embodiments of the present invention. Like reference numerals on different drawings will denote like components, and similar reference numerals on different drawings will denote similar components, but are not necessarily limited thereto.

Hereinafter, a configuration and an acting effect of exemplary embodiments of the present invention will be described in more detail with reference to the accompanying drawings.

FIG. 1 is a perspective view illustrating a choke coil according to an exemplary embodiment of the present invention.

Referring to FIG. 1, a choke coil 100 according to an exemplary embodiment of the present disclosure may include a core 110, and a primary coil 120 and a secondary coil 130 wound around the core 110.

Figure 2:
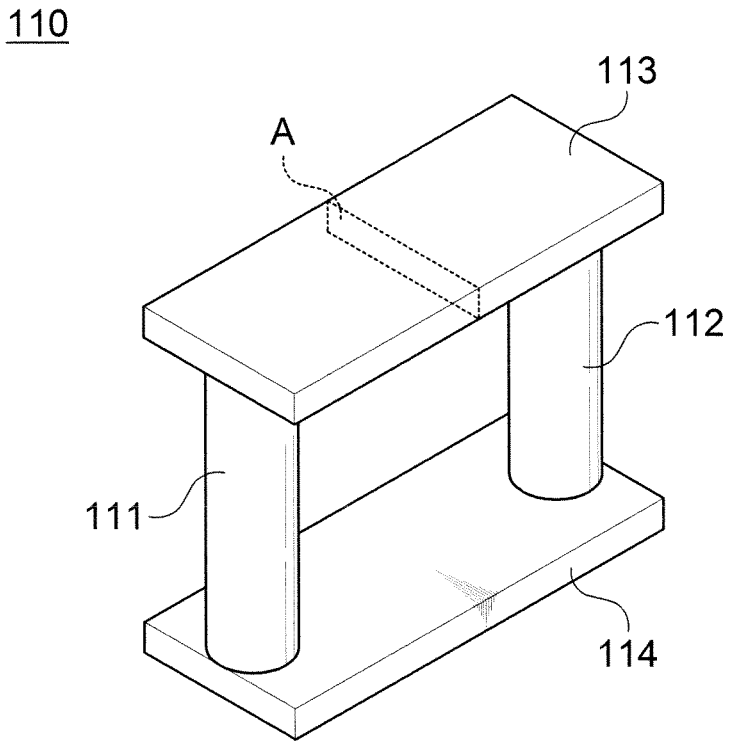
FIG. 2 is a perspective view illustrating a core included in the choke coil according to an exemplary embodiment of the present invention.

FIG. 2 is a perspective view illustrating the core 110 before the primary coil 120 and the secondary coil 130 are wound therearound, in which the core 110 includes a first leg 111, a second leg 112, a first flat plate 113, and a second flat plate 114, which are formed of a magnetic substance and which are integrally combined to form a closed-magnetic circuit.

In detail, the first leg 111 and the second leg 112 are spaced apart from one another in a facing manner at a predetermined distance. The first flat plate 113 may be combined to connect an upper end portion of the first leg 111 and that of the second leg 112, and the second flat plate may be combined to connect a lower end portion of the first leg 111 and that of the second leg 112.

In the drawing, the first leg 111 and the second leg 112 have a cylindrical shape, but the present disclosure is not limited thereto and the first leg 111 and the second leg 112 may have a square pillar shape.

The primary coil 120 and the secondary coil 130 may be respectively wound around the first leg 111 and the second leg 112 to form electromagnetic coupling.

Figure 3:
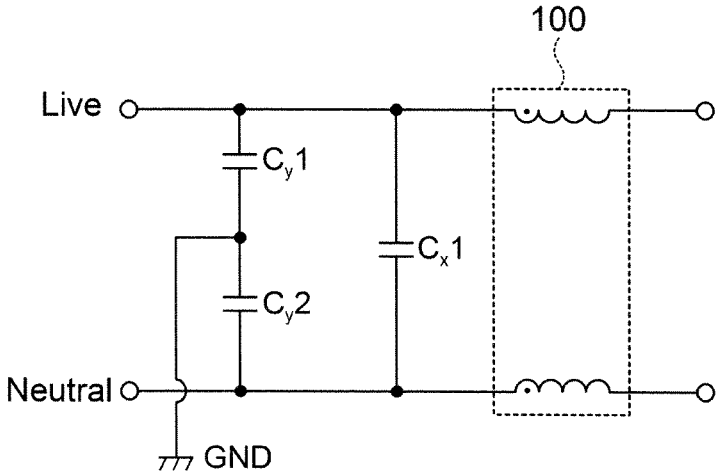
FIG. 3 is a view schematically illustrating an EMI filter employing a choke coil according to an exemplary embodiment of the present invention.

FIG. 3 is a view schematically illustrating an EMI filter employing a choke coil according to an exemplary embodiment of the present invention, in which the primary coil 120 and the secondary coil 130 are wound in the opposite directions such that the primary coil 120 is connected to a live terminal of a power line, while the secondary coil 130 may be connected to a neutral terminal.

Accordingly, the choke coil 100 according to the exemplary embodiment of the present invention may cancel electromagnetic interference of a common mode flowing in the power line through first and second Y capacitors $C_Y$1 and $C_Y$2 connected in series between the live terminal and the neutral terminal, and may cancel electromagnetic interference of a differential mode flowing in the power line through an X capacitor $C_X$1 connected in parallel to the first and second Y capacitors $C_Y$1 and $C_Y$2 between the live terminal and the neutral terminal.

Figure 4:
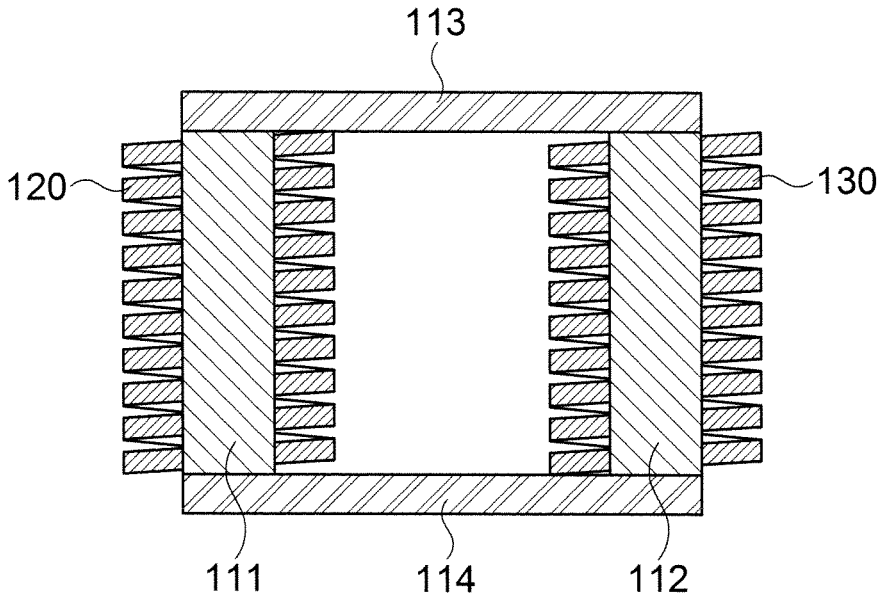
FIG. 4 is a cross-sectional view taken along line I-I' in FIG. 1.

FIG. 4 is a cross-sectional view taken along line I-I' in FIG. 1, in which the primary coil 120 and the second coil 130 may have a flat type copper wire having a quadrangular shape, rather than a circular shape, in a cross-section thereof.

In this case, compared to a coil having a circular cross-section, the coil may be wound densely to obtain required inductance even with a uni-layer structure of 1 turn, as illustrated in FIG. 4. When the coil is wound to have a uni-layer structure, parasitic capacitance may be reduced, and the reduction in parasitic capacitance may lead to an increase in a resonance frequency, expectedly allowing the choke coil 100 according to the present invention to have an increased cutoff frequency band.

Meanwhile, the core 110 and the primary coil and the core 110 and the secondary coil 130 should be electrically insulated, and thus, surfaces of the primary coil 120 and the secondary coil 130 may be coated with an insulator. Alternatively, surfaces of the first leg 111 and the second leg 112 around which the primary coil 120 and the secondary coil 130 are wound may be coated to be insulated.

Figure 5:
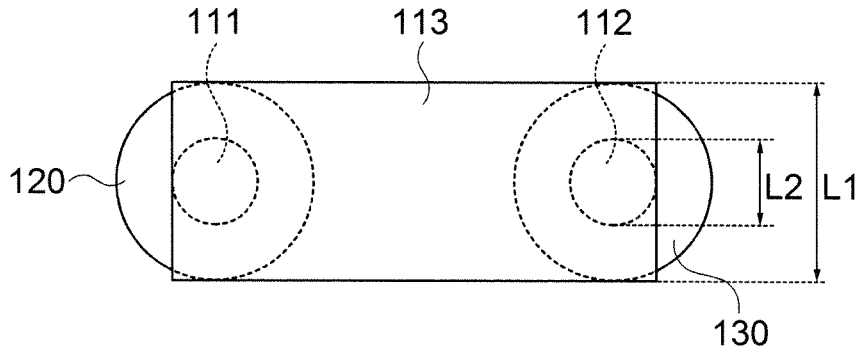
FIG. 5 is a plan view illustrating the choke coil illustrated in FIG. 1.

FIG. 5 is a plan view illustrating the choke coil illustrated in FIG. 1. Referring to FIG. 5, in the choke coil 100, a width L1 of at least any one of the first flat plate 113 and the second flat plate 114 may be greater than a width L2 of the first leg 111 and the second leg 112 (hereinafter, the first flat plate 113 will be largely described and the description of the first flat plate 113 will be applied to the second flat plate 114 in the same manner).

Thus, a cross-sectional area (A in FIG. 2) of the first flat plate 113 perpendicular to magnetic flux formed along the core 110 may be increased, relative to that of the related art, and as a result, magnetizing inductance Lm may be increased.

In addition, since the overall surface area of the first flat plate 113, as well as the cross-sectional area A, is increased, leakage inductance is increased based on a relationship of $Lk=(1-k^2)*Lm$ (here, Lk is leakage inductance and k is a coupling factor between the primary coil 120 and the secondary coil 130).

In order to improve the magnetizing inductance Lm and the leakage inductance Lk, the width L1 of the first flat plate 113 needs to be increased. In this case, however, a height of the mounted choke coil is increased, failing to meet consumer demand for lighter, thinner, shorter, and smaller products.

Figure 6:
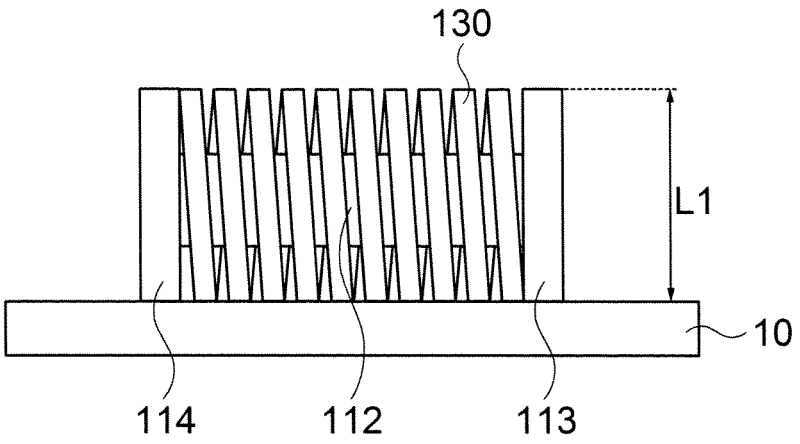
FIG. 6 is a side view schematically illustrating a choke coil mounted on a board according to an exemplary embodiment of the present invention.

Namely, FIG. 6 is a side view schematically illustrating a choke coil mounted on a board according to an exemplary embodiment of the present invention. In this case, in a case that the primary coil 120 and the secondary coil 130 are horizontal type coils which are horizontally mounted on a board 10, if the width L1 of the first flat plate 113 is excessively large, a height of the mounted choke coil 100 may be increased.

Thus, in the choke coil 100 according to the exemplary embodiment of the present invention, preferably, the width L1 of the first flat plate 113 is adjusted to be equal to a width (outer diameter) of the primary coil 120 and the secondary coil 130 such that the height of the mounted choke coil 100 may not exceed the width of the primary coil 120 and the secondary coil 130.

Figure 7:
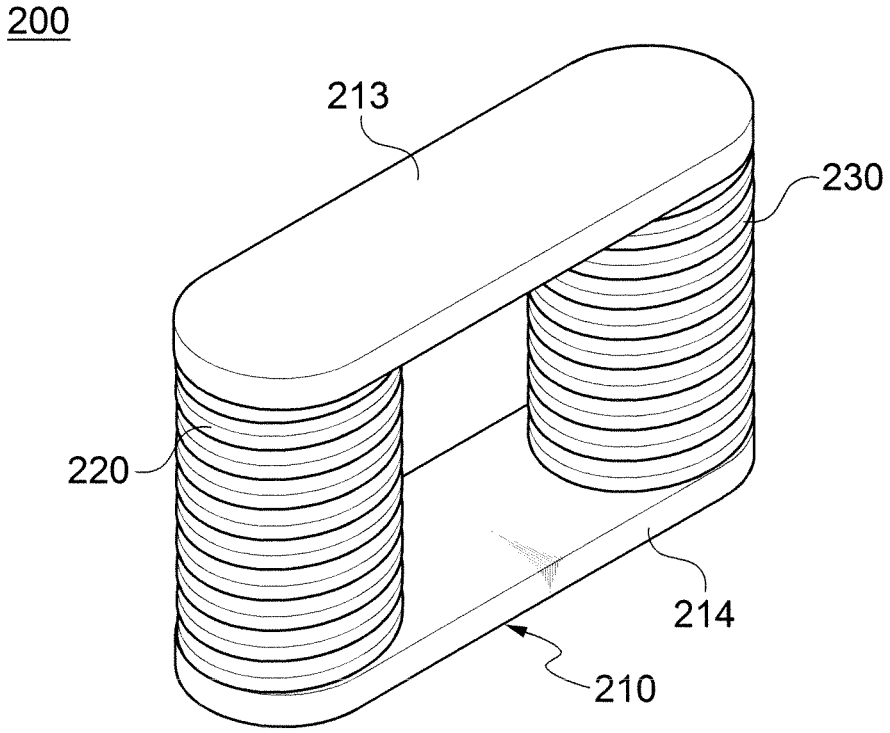
FIG. 7 is a perspective view illustrating a choke coil according to another exemplary embodiment of the present disclosure.
Figure 8:
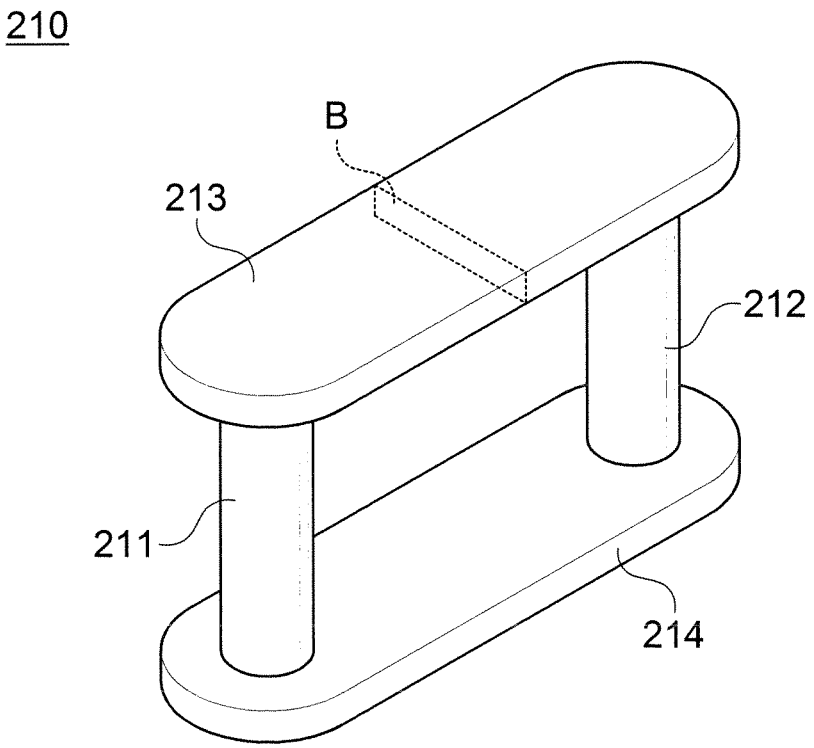
FIG. 8 is a perspective view illustrating a coil included in the choke coil according to another exemplary embodiment of the present invention.

FIG. 7 is a perspective view illustrating a choke coil according to another exemplary embodiment of the present disclosure, and FIG. 8 is a perspective view illustrating a coil before the primary coil and the secondary coil are wound therearound in FIG. 7.

Referring to FIGS. 7 and 8, like the configuration illustrated in FIGS. 1 and 2, a choke coil 200 according to another exemplary embodiment of the present invention may include a core 210 having a structure in which a first leg 211, a second leg 212, a first flat plate 213, and a second flat plate 214 are integrally combined, a primary coil 220 wound around the first leg 211, and a secondary coil 230 wound around the second leg 212.

Figure 9:
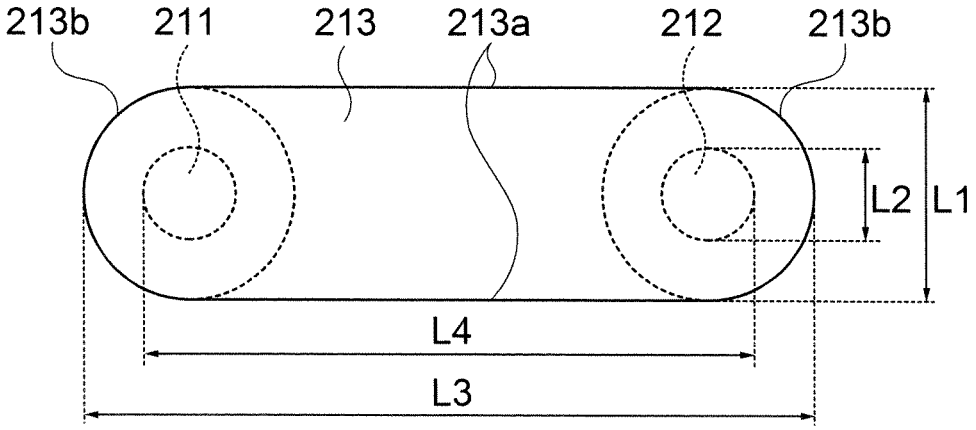
FIG. 9 is a plan view illustrating the choke coil illustrated in FIG. 7 according to another exemplary embodiment of the present invention.

FIG. 9 is a plan view illustrating the choke coil illustrated in FIG. 7. Here, the first flat plate 213 may include two linear lines 213*a* disposed to be parallel in a longer axis direction and two curved linear 213*b* connecting both ends of the two linear lines 213*a*. Similarly, the second flat plate 214 may include two linear lines disposed to be parallel in the longer axis direction and two curved lines connecting both ends of the two linear lines (hereinafter, the first flat plate 213 will be largely described and the description of the first flat plate 213 will be applied to the second flat plate 114 in the same manner).

Here, a distance between two linear lines 213*a* constituting the first flat plate 213, namely, a width L1, may be greater than a width L2 of the first leg 211 and the second leg 212, and a distance between the two curve lines 213*b*, namely, a length L3, may be greater than a distance L4 between an outer side wall of the first leg 211 and an outer side wall of the second leg 212.

Namely, in the present exemplary embodiment, the entire side walls of the first flat plate 213 may be protruded, relative to the side walls of the first leg 211 and the second leg 212. Thus, a cross-sectional area (B in FIG. 8) of the first flat plate 213 perpendicular to magnetic flux formed along the core 210 and an overall surface area of the first flat plate 213 are increased to be greater, and as a result, magnetizing inductance Lm and the leakage inductance Lk may be significantly increased.

In this case, in order to prevent a height of the mounted choke coil on the board from being increased, preferably, the width L1 of the first flat plate 213 is adjusted to be equal to a width (outer diameter) of the primary coil 220 and the secondary coil 230.

Also, a length of the linear line 213*a* constituting the first flat plate 213 is equal to a distance between a central point of the first leg 211 and that of the second leg 212, and a radius of curvature of the curved line 213*b* constituting the first flat plate 213 is equal to that of the primary coil 220 and the secondary coil 230.

In such a case, the curved line 213*b* region of the first flat plate 213 is aligned with outer circumferential surfaces of the primary coil 220 and the secondary coil 230 in a vertical line, and accordingly, the primary coil 220 and the secondary coil 230 may be stably supported by the outer protruded portions of the first and second flat plates 213 and 214. As a result, the primary coil 220 and the secondary coil 230 may be stably wound without a wobble, during a winding operation, reducing characteristic variations.

Meanwhile, a thickness of the first flat plate 213 may be adjusted to allow the choke coil 200 according to the exemplary embodiment of the present invention to have magnetizing inductance value Lm identical to that of the related art choke coil.

Namely, by reducing a thickness by the area increment based on the increase in the width L1 of the first flat plate 213, a cross-sectional area of the core perpendicular to magnetic flux in the related art choke coil and the cross-sectional area b of the core 210 perpendicular to magnetic flux in the choke coil according to the exemplary embodiment of the present disclosure are equalized.

In this case, the magnetizing inductance Lm is not improved, but an overall surface area of the first flat plate 213 is increased, and thus, the leakage inductance Lk may be improved and an area of the mounted choke coil on the board may be reduced.

Figure 10:
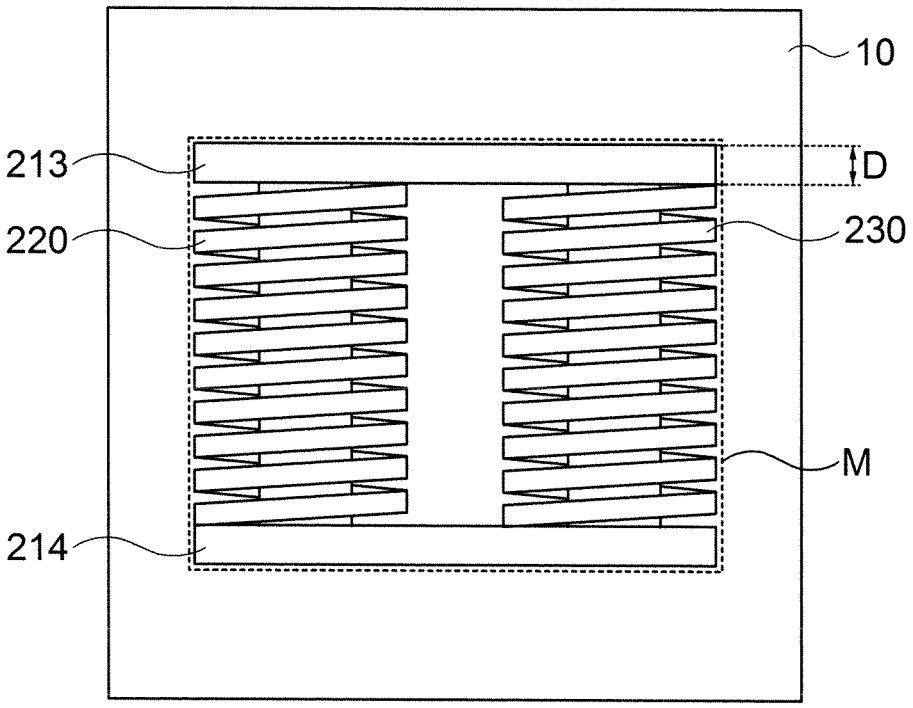
FIG. 10 is a plan view schematically illustrating a choke coil mounted on a board according to another exemplary embodiment of the present invention.

Namely, FIG. 10 is a plan view schematically illustrating a choke coil mounted on a board according to another exemplary embodiment of the present invention. In a case in which the primary coil 220 and the secondary coil are horizontal type coils horizontally mounted on the board 10, if a thickness D of the first flat plate 213 is reduced, the overall mounting area M of the choke coil 200 is also reduced as much, having an advantage of product miniaturization.

According to the exemplary embodiments of the present invention, magnetizing inductance Lm and leakage inductance Lk may be maximized within a range in which a size of the exterior of a product is not increased.

Also, since a primary coil and a secondary coil are stably wound without a wobble during a process, characteristic variations may be reduced, and ease of processing may enhance efficiency of production and reduce manufacturing costs.

The present invention has been described in connection with what is presently considered to be practical exemplary embodiments. Although the exemplary embodiments of the present invention have been described, the present invention may be also used in various other combinations, modifications and environments. In other words, the present invention may be changed or modified within the range of concept of the invention disclosed in the specification, the range equivalent to the disclosure and/or the range of the technology or knowledge in the field to which the present invention pertains. The exemplary embodiments described above have been provided to explain the best state in carrying out the present invention. Therefore, they may be carried out in other states known to the field to which the present invention pertains in using other inventions such as the present invention and also be modified in various forms required in specific application fields and usages of the invention. Therefore, it is to be understood that the invention is not limited to the disclosed embodiments. It is to be understood that other embodiments are also included within the spirit and scope of the appended claims.

What is claimed is:

1. A choke coil comprising:

a core composed of first and second legs, a first flat plate connecting an upper end portion of the first leg and that of the second leg, and a second flat plate connecting a lower end portion of the first leg and that of the second leg;

a primary coil wound around the first leg; and a secondary coil wound around the second leg, wherein widths of the first flat plate and the second flat plate, which are shorter than lengths thereof, are greater than widths of horizontal cross-sections of the first leg and the second leg and are equal to widths of horizontal cross-sections of the primary coil and the secondary coil, such that the primary coil and the secondary coil do not protrude beyond edges of the first and second flat plates in width directions thereof, at least one of the first flat plate and the second flat plate includes two linear lines disposed to be parallel to a direction of the length thereof and two curved lines connecting both ends of the two linear lines, and a curved line region of the first flat plate or the second flat plate is identical to outer circumferential surfaces of the primary coil and the secondary coil in a vertical line.

2. The choke coil according to claim 1, wherein the length of at least one of the first flat plate and the second flat plate is greater than a distance between an outer side wall of the first leg and an outer side wall of the second leg.

3. The choke coil according to claim 1, wherein the primary coil and the secondary coil have a flat type copper wire.

4. The choke coil according to claim 1, wherein surfaces of the primary coil and the secondary coil are coated with an insulator.

5. The choke coil according to claim 1, wherein the first leg and the second leg have a cylindrical shape or a square pillar shape.

6. The choke coil according to claim 1, wherein the first leg, the second leg, the first flat plate, and the second flat plate constituting the core are integrally formed.

* * * * *